US006910496B2

(12) United States Patent
Strom

(10) Patent No.: US 6,910,496 B2
(45) Date of Patent: Jun. 28, 2005

(54) GAS CONVERSION ASSEMBLY

(75) Inventor: Andrew T. Strom, Circle Pines, MN (US)

(73) Assignee: Honeywell International, Inc., Morristown, NJ (US)

( * ) Notice: Subject to any disclaimer, the term of this patent is extended or adjusted under 35 U.S.C. 154(b) by 364 days.

(21) Appl. No.: 10/123,624

(22) Filed: Apr. 15, 2002

(65) Prior Publication Data

US 2003/0192591 A1 Oct. 16, 2003

(51) Int. Cl.[7] ..... F23D 11/36

(52) U.S. Cl. ..... 137/269; 137/271; 137/489; 251/26

(58) Field of Search ..... 251/26, 129.04; 137/269, 271, 489, 624.11, 624.12; 431/156

(56) References Cited

U.S. PATENT DOCUMENTS 4,614,168 A 9/1986 Batchelor ..... 123/27 GE
4,718,448 A * 1/1988 Love et al. ..... 137/271
4,962,749 A 10/1990 Dempsey et al. ..... 126/116 A
5,413,141 A * 5/1995 Dietiker ..... 137/489
5,435,343 A * 7/1995 Buezis ..... 137/489
5,450,841 A 9/1995 Whitaker et al. ..... 126/512
6,068,017 A 5/2000 Haworth et al. ..... 137/271
6,261,087 B1 7/2001 Bird et al. ..... 431/80

* cited by examiner

*Primary Examiner*—Kevin Lee
(74) *Attorney, Agent, or Firm*—Gregory M. Ansems

(57) ABSTRACT

A gas conversion assembly generally has a gas inlet and a gas outlet. The assembly includes a control mechanism for regulating the flow of gas from the inlet to the outlet. The control mechanism is constructed and arranged to adjust from regulating the flow of a first gas to regulating the flow of a second gas. The control mechanism has an actuator for switching the control mechanism from its first arrangement for regulating a first gas to its second arrangement for regulating a second gas.

24 Claims, 5 Drawing Sheets

GAS CONVERSION ASSEMBLY

BACKGROUND OF THE INVENTION

The present invention generally relates to gas control assemblies. In particular, the present invention relates to a gas control assembly that can be utilized, for converting an appliance from a first arrangement, wherein a first gas is used, to a second arrangement, wherein a second gas is used.

Traditionally, devices that utilize one type of gas cannot be operated using a second type of gas. One reason for this is that the pressure of one gas is different from the pressures of others. Accordingly, a conduit sized to allow the flow of a predetermined quantity of gas through the conduit will allow a different amount of a second gas through the conduit and, therefore, the system may not be able to function properly with the different amount of gas present. For example, a device suitable for use with natural gas may be calibrated to operate within the range of 1.7 to 3.5 water column inches of gas pressure. Whereas, a device utilizing propane (lp gas) and having similar output characteristics may operate within the range of 6.3 and 10 inches water column. Consequently, if not adjusted, a device set up to operate with one of the above gases may either have too much gas flowing through the conduit or too little gas. Additionally, prior art devices cannot be utilized with a variety of gases because the amount of energy each gas provides when combusted is different due to its pressure and combustibility. These differences can lead to the overheating of parts of the assembly and may lead to damage or malfunction of the components of the assembly or appliance to which the assembly is connected.

Some devices have safety mechanisms built into their systems so that overheating does not occur. Typically, these systems shut down the appliance before damage or malfunction can occur. However, this may save the appliance, but may be a nuisance if the appliance cannot be used for a suitable period of time before the safety device is activated.

Additionally, prior art assemblies cannot be operated without having the assembly connected to electrical line power. This limits the use of these assemblies to only areas having access to line power. Therefore, remote locations, such as cabins, and the like, with no access to line power cannot make use of these gas appliances.

Furthermore, prior art assemblies do not allow for the flow of gas to be remotely adjusted, thereby modulating the amount of gas combusted. In particular, prior art devices do not make use of radio frequency receivers to allow for accurate modulation of the flow of gas.

The present invention addresses these needs, as well as other problems associated with the prior art. The present invention offers advantages over the prior art and solves problems associated therewith.

SUMMARY OF THE INVENTION

The present invention provides a gas conversion assembly for converting an appliance from using a first gas to using a second gas. The device includes a gas inlet and a gas outlet and a conduit between the inlet and the outlet. The device also has a control mechanism for regulating the flow of gas from the inlet to the outlet through the conduit. Ideally, the same conduit is utilized with both a first gas and a second gas during the control of a first gas and the control of a second gas. The control mechanism is constructed and arranged to change from regulating the flow of a first gas to regulating the flow of a second gas. The control mechanism has an actuator for switching the control mechanism from a first arrangement, for regulating a first gas, to a second arrangement, for regulating a second gas.

In another embodiment, the actuator is a switch that actuates the control mechanism to switch from the first arrangement to the second arrangement. Additionally, the actuator may have a circuit board for instructing the control mechanism to switch from the first arrangement to the second arrangement. Further, the actuator may have a shunt that, when attached to the circuit board, switches the control mechanism from the first arrangement to the second arrangement. The circuit board may have a three pin connector thereon and the shunt is constructed to be placed over two of the pins to form a short between the pins. In this embodiment, the short establishes that the control mechanism must use a predetermined one of the plurality of arrangements. In one embodiment, the control mechanism for regulating a first gas includes software for instructing the control mechanism to regulate the quantity of the first gas flowing through the conduit.

The control mechanism may also have a rough adjustment mechanism for adjusting the assembly to operate with gases of different densities, and a fine adjustment mechanism for fine adjustment of the flow of gas through the conduit. The fine adjustment mechanism may also be designed to provide different fine adjustment increments for each gas. Additionally, the fine adjustment mechanism may be controlled either locally and/or remotely. In an remote controlled embodiment, it is preferred that the fine adjustment mechanism has a radio frequency receiver and the receiver receives remote commands to initiate a fine adjustment of the flow of gas through the conduit.

The control mechanism preferably includes a motor for adjusting the flow of gas. The motor may be operated two gas type positions, a first gas type position to adjust the flow of a first gas and then the motor may be moved to a second gas type position to adjust the flow of a second gas.

A software interface that has software programming to control the adjustment of the flow of gas by the motor may be employed. The software may be designed having a first set of software protocols for the adjustment of the flow of the first gas and a second set of protocols for the adjustment of the flow of a second gas. The printed circuit board and shunt embodiment may be implemented with this design such that when the shunt is attached to the circuit board, the assembly switches the software operating in the software interface from the one set of protocols to another set. This embodiment may also have a second shunt that, when the second shunt is attached to the circuit board, the assembly switches the software operating in the software interface from the one set of protocols to another set. The plurality of shunts may be utilized to indicate a switch from one set of protocols to another, or be utilized to identify a specific protocol to be utilized. For example, one shunt may specifically indicate to the assembly that a first set of protocols is to be utilized, while a different shunt may indicate that the assembly is to use a specific second set of protocols.

In one embodiment of the control mechanism, a motor may be utilized to regulate a valve that controls the quantity of gas flowing through the conduit. The valve may be a ball valve forming a portion of the conduit. The ball valve is preferably constructed and arranged to open and close and is preferably controlled by the motor.

In another embodiment, the motor has a motor shaft constructed and arranged to lengthen and shorten when actuated. One end of the motor shaft is arranged to abut a lever. The lever is positioned adjacent the valve and constructed such that when the motor shaft is lengthened the lever contacts the ball valve to open it and thereby opens the flow of gas through the conduit.

Additionally, at least one thermopile may be utilized to actuate the control mechanism. In this way, once combustion has begun, the assembly may be powered by the thermopile and, therefore, the appliance can be run without connection to line power.

The above mentioned benefits and other benefits of the invention will become clear from the following description by reference to the accompanying drawings.

DESCRIPTION OF THE PREFERRED EMBODIMENT

The present invention provides a gas conversion assembly 10 for converting an appliance from using a first gas to using a second gas. The device 10 includes a gas inlet and a gas outlet and a conduit between the inlet and the outlet. Ideally, the same conduit is utilized with both a first gas and a second gas during the control of a first gas and the control of a second gas.

Figure 1:
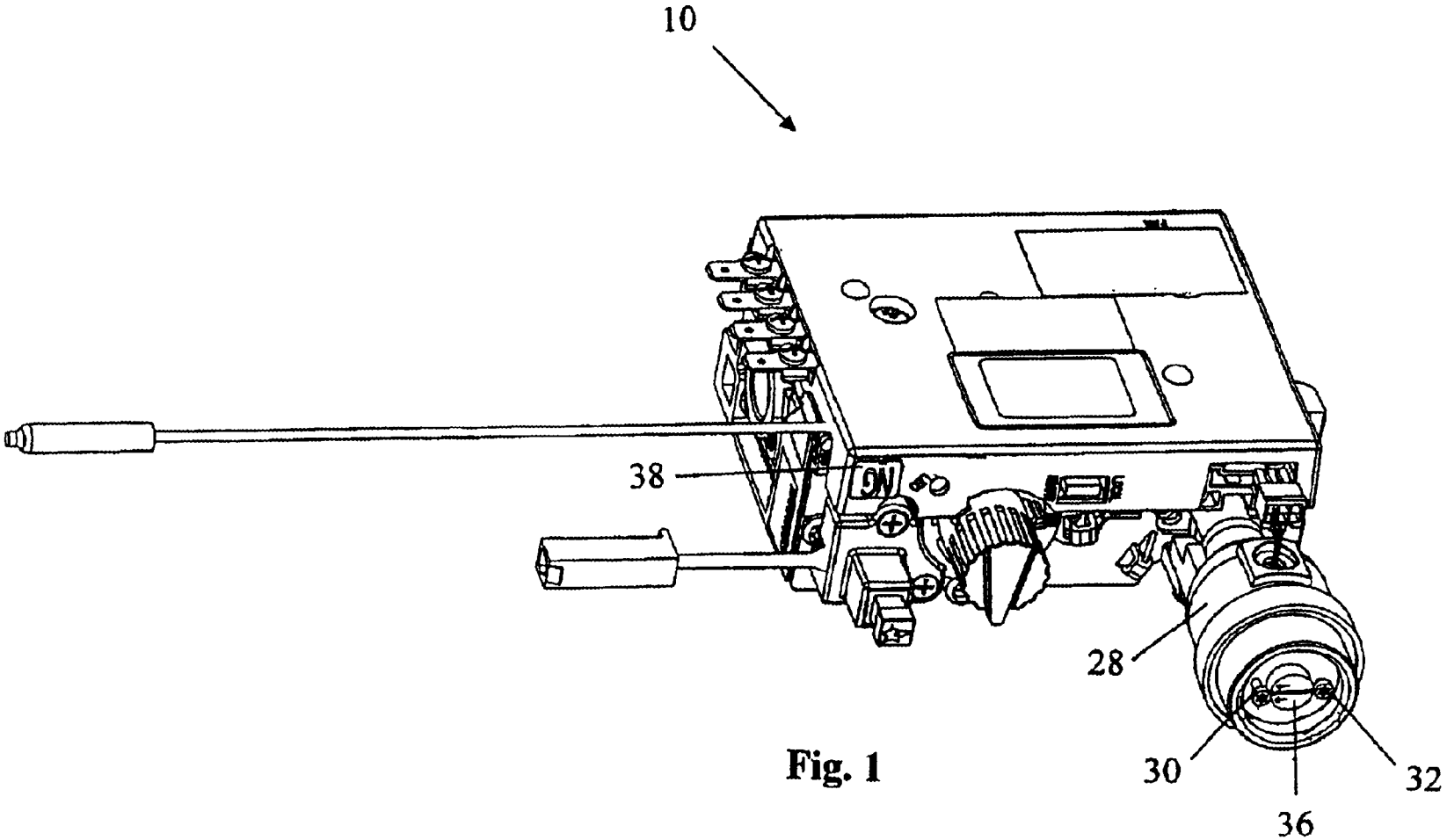
FIG. 1 illustrates an angled over head view of the exterior of a flow control assembly constructed according to the present invention.
Figure 2:
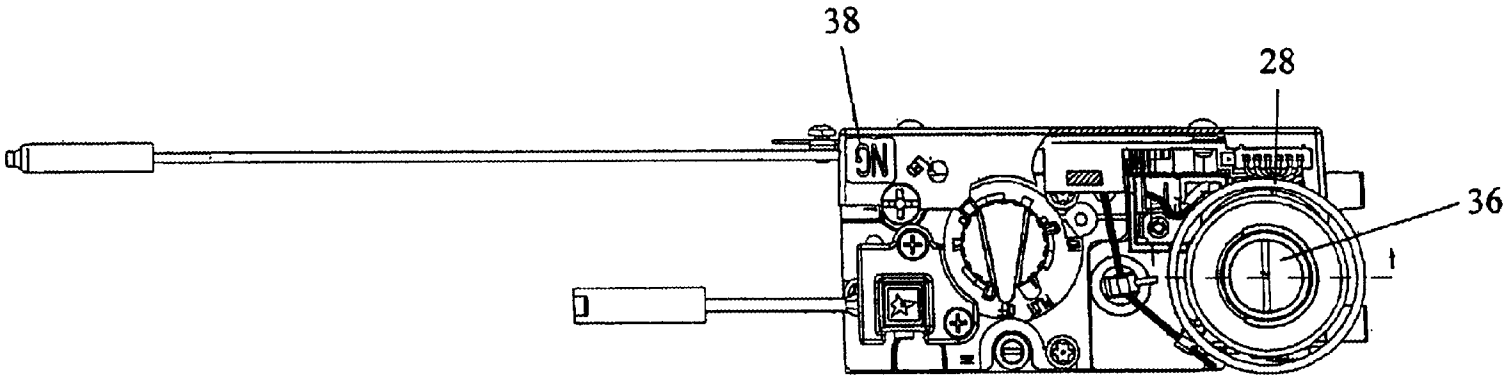
FIG. 2 illustrates an over head view of the exterior of the flow control assembly of FIG. 1.
Figure 3:
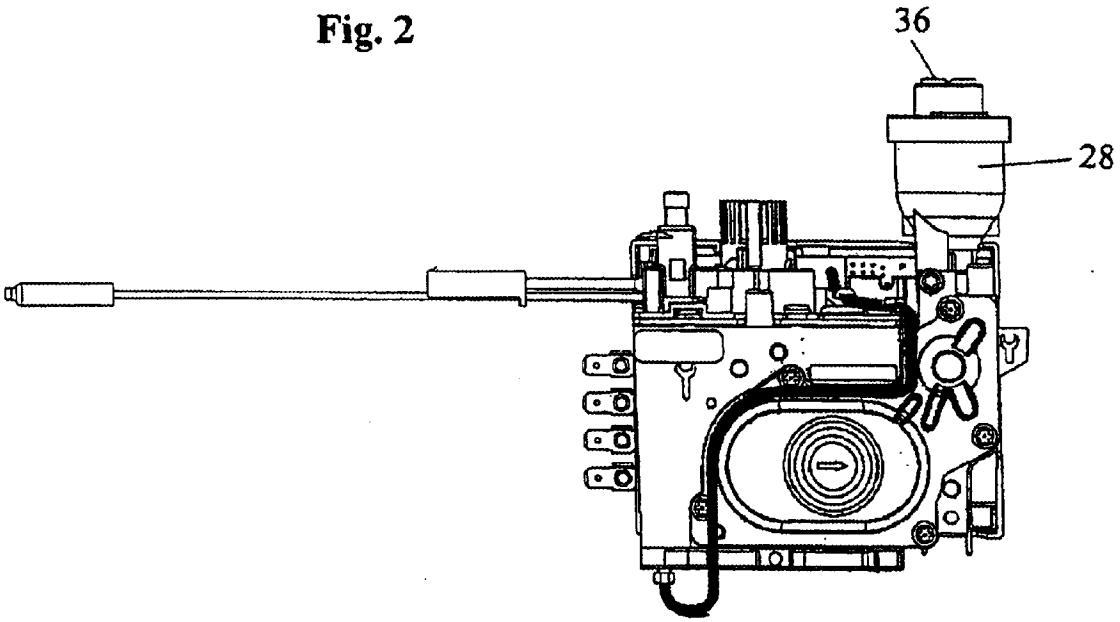
FIG. 3 illustrates a side view of the exterior of the flow control assembly of FIG. 1.
Figure 5:
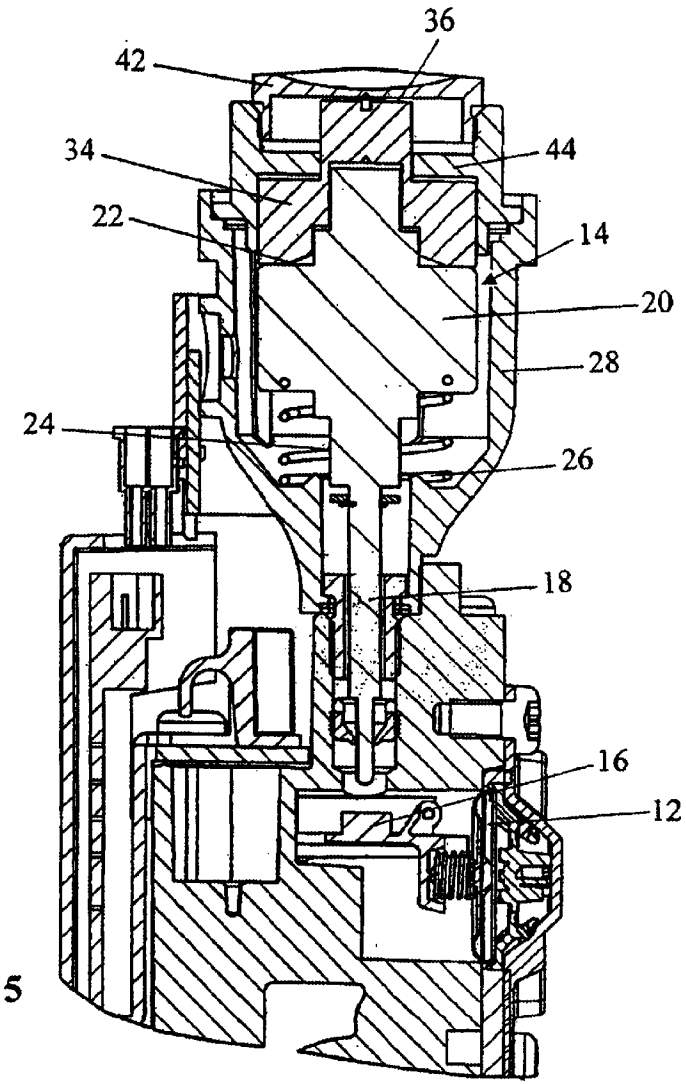
FIG. 5 illustrates a cut away end sectional view of the control mechanism of FIG. 1 showing the lever mechanism.

In the embodiment shown, the inlet and outlet are on the left and right ends of the device respectively. Since the general construction of gas regulators are known, it need only be known that the direction of the gas from the inlet to the outlet is from the left of the device shown, in FIGS. 1–3, to the right of the device. This information is merely provided to give perspective and is not intended to be limiting on the invention. For additional clarity an arrow is provided on the exterior of the device shown in FIG. 3 that indicates the direction of flow through the device.

Figure 6:
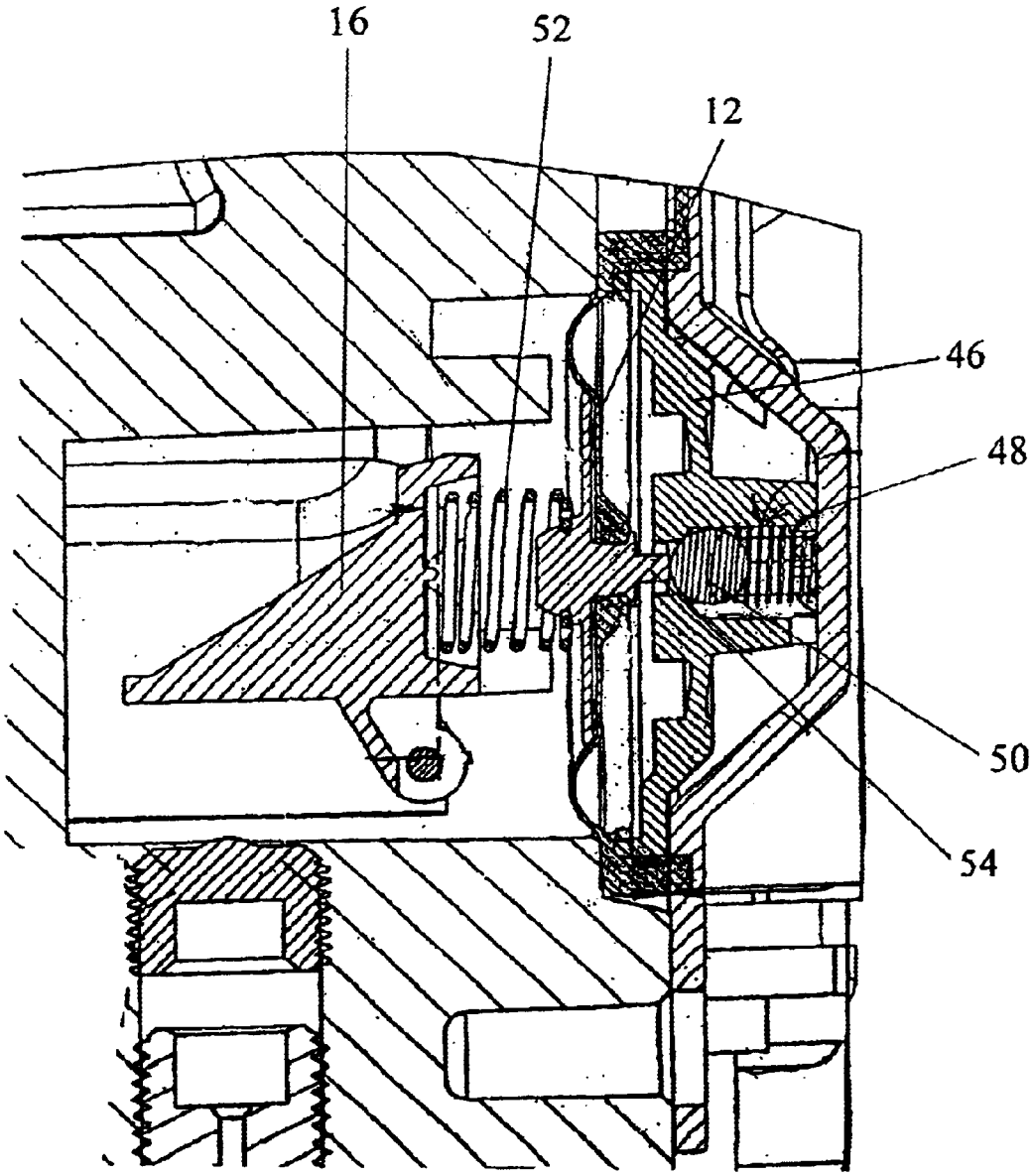
FIG. 6 illustrates a close up view of the lever and valve mechanism of FIG. 5.
Figure 7:
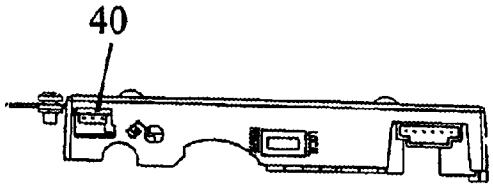
FIG. 7 illustrates a top view of a printed circuit board constructed according to one embodiment of the present invention.
Figure 8:
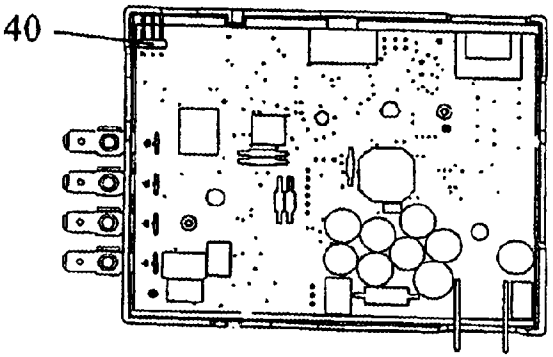
FIG. 8 illustrates a cut away side view of the printed circuit board of FIG. 7.
Figure 9:
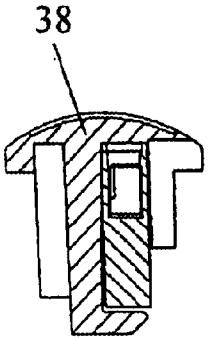
FIG. 9 illustrates a side view of a shunt for use with one embodiment of the present invention.
Figure 10:
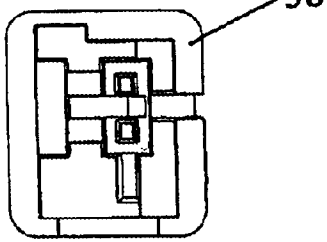
FIG. 10 illustrates a bottom view of the shunt of FIG. 9.
Figure 11:
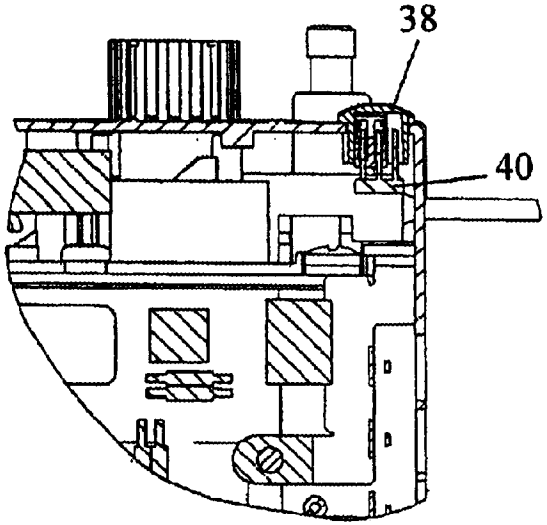
FIG. 11 illustrates a cut away side sectional view of an embodiment of the present invention showing the shunt mounted to two pins of a three pin connector attached to the circuit board.

The conduit has a restricting mechanism therein that is designed to adjustably restrict the amount of gas flowing therethrough. A restricting mechanism and associated structure act as a control mechanism for adjustment of the gas flow through the conduit. The restriction of the conduit may be accomplished by any means known in the art. The valve utilized to control the amount of gas flowing through the conduit, in the embodiment shown in FIG. 6, is a ball valve comprised of a ball housing 46, first spring 48, a ball 50, a second spring 52, and a pin 54. The ball housing 46 holds the ball 50 and the first spring 48 biases the ball against an aperture formed on the ball housing 46. The interface between the ball and the rim of the aperture forms the valve of the conduit through which the gas is regulated. The ball 50 is moved when a force is applied by the pin 54. The pin 54 is indirectly actuated by the lever 16. The direct actuation is provided by the second spring 52 that contacts a plate, mounted on the membrane 12, onto which the pin 54 is fixed. The membrane-plate-second spring assembly is designed to more precisely actuate the pin 54 to engage the surface of the ball 50.

The membrane 12 forms a portion the conduit and is constructed from a material that expands and contracts into the interior space of the conduit. Preferred materials are elastomeric and non-elastomeric materials, such as rubber, and the like. Additionally, the material may be formed as a simple membrane, or formed into expanding and contracting mechanical structures, such as bellows and the like. A motor 14 is preferably, utilized to actuate and adjust the movement of the valve. The range of movement of this motor 14 is designed to provide the fine adjustment of movement of the valve and thereby controls the fine adjustment of the flow of gas through the conduit.

Preferably, motor 14 is a stepper motor that controls the valve to restrict the gas flow in a series of steps. In this way, the level of combustion can be controlled in a series of steps. This is useful, for example, in a fireplace wherein it is desirable to have a series of flame levels. The stepper motor can increase or decrease the flame level in steps. Additionally, the fine adjustment mechanism may be controlled either locally and/or remotely. In a remote controlled embodiment, the fine adjustment mechanism preferably has a radio frequency receiver and the receiver receives remote commands to initiate a fine adjustment of the flow of gas through the conduit. Radio frequency communication is preferred because it allows for use of the controller without pointing the remote directly at the receiver.

In the embodiment shown, the valve is adjusted through use of the lever 16. The lever 16 is contacted by the end of a motor shaft 18 that extends from the motor 14. The motor 14 is utilized to extend or retract the motor shaft 18. The end of the motor shaft 18 contacts one surface of the lever 16. The lever 16 then moves the second spring 52 which in turn moves the plate and pin 54 and the membrane 12. The pin then pushes the ball toward the first spring 48 and opens a pathway between the ball 50 and the aperture in the housing 46.

When adjusting the device from a first arrangement for use with a first gas, to a second arrangement for use with a second gas, an actuator must change the configuration of the device. For gases necessitating the use of a substantially larger or substantially smaller conduit size, the device may be constructed such that a rough adjustment may be made. Additionally, the device may also be constructed having a separate fine adjustment structure for making fine adjustments to the general volume of gas. The rough and fine adjustments of the motor are provided within a range of positions for the specific gas to be used. The fine adjustment may be utilized to fine tune the rough adjustment and to provide adjustment by the user.

Figure 4:
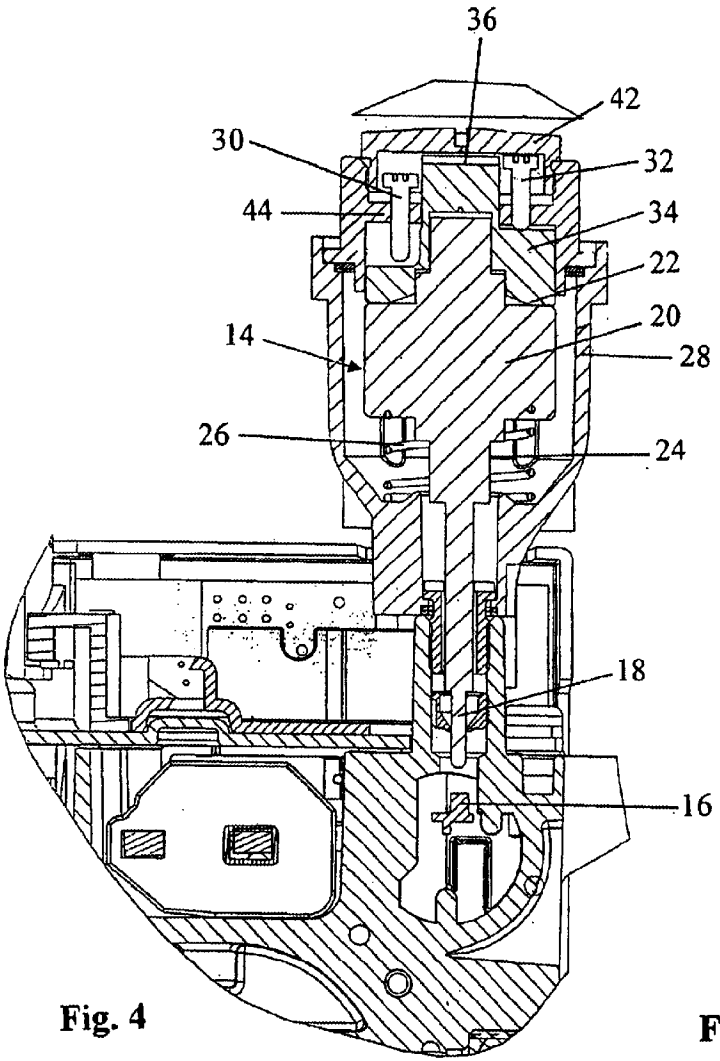
FIG. 4 illustrates a cut away side sectional view of a control mechanism constructed according to one embodiment of the present invention and shown in FIG. 1 wherein the motor assembly and set screws are shown.

The rough adjustment of the size of the conduit, and hence the amount of gas that may flow therethrough may be accomplished by any means known in the art including, but not limited to, electrical and mechanical based structures. For example, the embodiment shown provides rough adjustment by moving the position of the motor 14 from one position to another. One embodiment of a structure for positioning the motor 14 is provided as shown in the Figures. The motor 14 in the embodiment shown is comprised of a body 20 having a generally wide end 22 and a narrow end 24 that terminates in a motor shaft 18 having an end thereon. The end of the motor shaft 18 is utilized to contact the lever 16 which, in turn, opens the conduit. The motor 14 is biased to a first position, for example, by a spring 26 as shown in the Figures. The biasing allows the motor 14 to return to its initial position. The motor 14 has a housing 28 around it with a top 44. The top 44 of the housing 28 has an interior surface that has at least two contact surfaces formed thereon, at least one surface that is closer to the wide end 22 of the motor 14 than another. In the case of the embodiment shown, the different surfaces of the top of the housing are provided by adjustable screws 30 and 32, thereby allowing the distances to be more precisely tuned. A plunger 34 is placed between the wide end 22 of the motor 14 and the top of the housing 28. The plunger 34 has at least two thicknesses. The first thickness is designed such that when it is in contact with the closer surface of the top 44 of the housing 28, it positions the motor 14 in a first position. The second thickness of the plunger 34 should be such that when the plunger 34 is turned to contact the second surface of the top 44 of the housing 28, the second surface of the plunger 34 does not contact any of the top surface of the top 44 of the housing 28. In this way, the first surface of the plunger 34 can be utilized to control the positioning of the motor 14 without interference from the second surface of the plunger 34. As can be seen in FIG. 4, the second surface of the plunger 34 is not in contact with screw 30. In one embodiment, a portion of the surface of the plunger 34 is eliminated, such that the second thickness is the thickness of the plunger 34 itself. Additionally, in the embodiment shown, the plunger 34 is provided with a control element 36 that a screwdriver can engage to facilitate the turning of the plunger 34. A cap 42 may cover the top of the housing 28. Since it is preferred that the screws be preset before being provided to a user, the cap 42 may be applied to hide the tops of the adjustment screws 30 and 32, so that the user does not adjust them.

Preferably, the function of the motor 14 is controlled by circuitry provided on a printed circuit board. The circuitry may have a plurality of protocols programmed therein for changing the operation of the motor with respect to the device being operated with different gases. These protocols may be provided by software that is preprogrammed into the circuitry.

The device 10 may also utilize one or more shunts 38. The shunts 38 may be connected to the printed circuit board to indicate to the device 10 which protocol it is to use. Preferably, in an embodiment wherein the device 10 is to determine between only two protocols, the circuit board is designed with a three pin connection 40, wherein when two of the three pins are shorted together, the circuit runs one protocol and when un-shorted, a second protocol is run. Alternatively, the device 10 may be designed for use with a second shunt 38, wherein when two other pins are shorted, a second protocol is run and when there is no short, the device 10 will not operate. As an additional safety configuration, each shunt 38 can have one or more distinguishing features such as a text identifier thereon or a color that identifies which gas protocol will be run if the shunt is attached to the circuit.

The motor 14 is preferably powered by electricity. The electricity may be provided by line power or by one or more thermopiles. The motor and circuitry connected thereto may be constructed to run on as little as 500 mV and, thereby, a single thermopile can generate enough energy from combustion of gas to power the motor and run the circuitry that controls the motor. The one or more thermopiles may even generate enough energy to allow the circuit to perform other functions programmed therein or run other mechanisms connected thereto, such as initialization of the system, safety procedures, and the like.

The embodiment shown in the figures is constructed to be used as follows. The device shown in the figures is capable of switching from use with a first gas to use with a second gas. Accordingly, plunger 32 has two thicknesses and the top 44 of housing 28 has two surfaces. In the embodiment shown, the device has two screws 30 and 32 to define the surfaces of the top 44. The device shown is set for use with propane (LP) and natural gas (NG).

The device is preferably calibrated for use when manufactured, but may be calibrated at the installation site. The calibration for an adjustable embodiment such as the one shown is accomplished by adjusting each screw such that the end of the screw, that is within the housing 28, is set to a level wherein the valve regulating gas flow is in the correct position to provide a suitable amount of gas flow through the conduit. As can be seen in FIG. 4, screw 32 is set higher than screw 30. Screw 32 is set for use with NG, while screw 30 is set for use with LP. Once the set screws 30 and 32 are calibrated for their specific gases, it is likely that they will not have to be adjusted again. This is because the screws provide precise rough alignment of the motor such that, when switching the device from operating with one gas to operating with the other, the plunger may simply be turned, or depressed and turned if necessary, to change the valve precisely from one gas configuration to the other. To aid in knowing which gas the device is set for, the plunger may have an indicator, such as an arrow, on its visible top surface. The arrow may be arranged to point to the screw that is currently in contact with the plunger or to any other suitable indicator known in the art. Additionally, the screws may be color coded, for example, by having the screw set to NG colored blue and the screw set to LP colored red. The shunts that are utilized with this embodiment may also be color coded in the same way. The device shown in FIG. 4 has been set to be used with screw 32, which has been calibrated to operate with NG. However, the embodiment shown will not operate until a shunt 38 has been placed over a three pin connector 40 located on the circuit board.

It is preferred that each device be provided to the user with two shunts, one for NG and one for LP. As a safety feature, the device is then constructed so that it will not operate without one of the shunts installed. It is also preferred that the shunts be differentiable by color, shape, text marking, or any other differentiable characteristic known in the art. Since the device shown in FIG. 4 is set to NG, the correct shunt to place on the connector is the NG shunt.

This shunt is designed to short two of the three pins of the three pin connector together. The circuit board is designed such that when these particular two pins are shorted together, the device is to be used with NG gas and, therefore, the board is to adjust the motor according to a preset set of protocols programmed into the board for operating with NG.

The board also has a preset set of protocols for operating with LP, and these parameters are implemented when the LP shunt is utilized. Finally, the device may be connected to the gas line at its inlet and outlet ports.

Although the present invention has been described with reference to preferred embodiments, workers skilled in the art will recognize that changes may be made in form and detail without departing from the spirit and scope of the invention. Additionally, since many possible embodiments may be made of the present invention without departing from the scope thereof, it is to be understood that all matter herein set forth or shown in the accompanying drawings is to be interpreted in the illustrative and not a limiting sense.

That which is claimed is:

1. A gas conversion assembly for converting an appliance from using a first gas to using a second gas, comprising;

a gas inlet and a gas outlet;

a conduit connected between said inlet and said outlet; and a control mechanism for regulating the flow of gas from said inlet to said outlet through said conduit, said control mechanism constructed and arranged to adjust from regulating the flow of a first gas to regulating the flow of a second gas, said control mechanism having an actuator for shifting said control mechanism from a first position, for regulating the first gas, to a second position, for regulating the second gas.

2. The assembly according to claim 1, wherein said control mechanism for regulating a first gas includes software for instructing the control mechanism to regulate the quantity of said first gas flowing through said conduit.

3. The assembly according to claim 1, wherein said actuator comprises a control element for switching the control mechanism from said first arrangement to said second arrangement.

4. The assembly according to claim 3, wherein said actuator comprises a circuit board for instructing the control mechanism to switch from said first arrangement to said second arrangement.

5. The assembly according to claim 4, wherein said actuator further comprises a shunt that when attached to said circuit board switches said control mechanism from said first arrangement to said second arrangement.

6. The assembly according to claim 5, wherein said circuit board has a three pin connector thereon and wherein said shunt is placed over two of said pins to form a short between said pins and wherein the short establishes that said control mechanism must use said first arrangement.

7. The assembly according to claim 1, wherein said conduit is utilized with both the first gas and the second gas during the control of a first gas and the control of a second gas.

8. The assembly according to claim 1, wherein said control mechanism has a rough adjustment mechanism for adjusting said assembly to operate with gases of different densities, and a fine adjustment mechanism for fine adjustment of the flow of gas through said conduit.

9. The assembly according to claim 8, wherein the fine adjustment mechanism provides different fine adjustment increments for each gas.

10. The assembly according to claim 1, wherein said control mechanism includes a motor for adjusting the flow of gas.

11. The assembly according to claim 10, wherein said motor has a motor shaft and wherein said motor shaft is operated in a first range of positions to adjust the flow of a first gas and second range of positions to adjust the flow of a second gas.

12. The assembly according to claim 11, wherein said assembly further comprises a software interface that has software programming to control the adjustment of said flow of gas by said motor, said software having a first set of software protocols for the adjustment of the flow of the first gas and a second set of protocols for the adjustment of the flow of the second gas.

13. The assembly according to claim 12, wherein said assembly further comprises a printed circuit and a shunt that, when said shunt is attached to said circuit board, said assembly switches the software operating in said software interface from said first set of protocols to said second set.

14. The assembly according to claim 12, wherein said assembly further comprises a second shunt that, when said second shunt is attached to said circuit board, said assembly switches the software operating in said software interface from said second set of protocols to said first set.

15. The assembly according to claim 10, wherein said motor regulates a valve that controls the quantity of gas flowing through said conduit.

16. The assembly according to claim 15, wherein said valve is a ball valve forming a portion of said conduit, said ball valve being constructed and arranged to open and close and wherein said motor controls the opening and closing of said valve.

17. The assembly according to claim 16, wherein said motor has a motor shaft constructed and arranged to lengthen and shorten when actuated and having an end, said end arranged to abut a lever, said lever positioned adjacent said valve and constructed such that when said motor shaft is lengthened said lever contacts said ball valve to open said valve and thereby opens the flow of gas through said conduit.

18. The assembly according to claim 1, wherein said assembly has a fine adjustment mechanism for fine adjustment of the flow of gas through said conduit and wherein said mechanism can be controlled both locally and remotely.

19. The assembly according to claim 18, wherein said fine adjustment mechanism has a radio frequency receiver and wherein said receiver receives remote commands to initiate a fine adjustment of the flow of gas through said conduit.

20. The assembly according to claim 1, wherein said assembly further comprises at least one thermopile, said thermopile utilized to actuate said control mechanism.

21. The assembly according to claim 3, wherein said control element switch is a rotatable plunger, that when rotated, switches said assembly from said first arrangement to said second arrangement.

22. A gas flow controller, for controlling the amount of gas through a conduit, the improvement comprising:

a control mechanism for regulating the flow of one of first and second gasses through said conduit, said control mechanism having a motor constructed and arranged to provide for a manually selectable change from a first structural arrangement for regulating the first gas, to a second structural arrangement for regulating the second gas.

23. The gas flow controller of claim 22, wherein the first structural arrangement comprises a first position for the motor for regulating the first gas, and the second structural arrangement comprises a second position for the motor for regulating the second gas.

24. A gas conversion assembly for converting an appliance from using a first gas to using a second gas, comprising;

a gas inlet and a gas outlet;

a conduit connected between said inlet and said outlet; and a control mechanism for regulating the flow of gas from said inlet to said outlet through said conduit, said control mechanism constructed and arranged to adjust from regulating the flow of a first gas to regulating the flow of a second gas, said control mechanism having an actuator for switching said control mechanism from a first arrangement, for regulating the first gas, to a second arrangement, for regulating the second gas, wherein said control mechanism for regulating the first gas includes software for instructing the control mechanism to regulate the quantity of said first gas flowing through said conduit.

* * * * *